US006412748B1

(12) United States Patent
Girard

(10) Patent No.: US 6,412,748 B1
(45) Date of Patent: Jul. 2, 2002

(54) GROUND ANCHORING MECHANISM

(75) Inventor: Martin Girard, Alma (CA)

(73) Assignee: Fix Plus, Alma (CA)

( * ) Notice: Subject to any disclaimer, the term of this patent is extended or adjusted under 35 U.S.C. 154(b) by 0 days.

(21) Appl. No.: 09/376,331

(22) Filed: Aug. 18, 1999

(51) Int. Cl.[7] ..... F16M 13/00
(52) U.S. Cl. ..... 248/530; 248/545
(58) Field of Search ..... 248/530, 523, 248/535, 156, 545, 539, 507, 508

(56) References Cited

U.S. PATENT DOCUMENTS

| | | | | |
|---|---|---|---|---|
| 2,211,283 A | | 8/1940 | Mercer | |
| 3,976,234 A | * | 8/1976 | Moudry et al. | 224/45 |
| 4,028,916 A | * | 6/1977 | Pender | 70/233 |
| 4,293,113 A | * | 10/1981 | Gray | 248/530 X |
| 4,832,304 A | | 5/1989 | Morgulis | |
| 5,152,495 A | | 10/1992 | Jacinto et al. | |
| 5,156,369 A | | 10/1992 | Tizzoni | |
| 5,482,246 A | | 1/1996 | Derkoski | |
| 5,535,978 A | | 7/1996 | Rodriguez et al. | |
| 5,639,057 A | * | 6/1997 | Yeomans | 248/530 |
| 5,687,946 A | * | 11/1997 | Cho | 248/530 |
| 5,749,386 A | | 5/1998 | Samuel, Jr. | |
| 5,988,194 A | * | 11/1999 | Collins | 248/530 X |

FOREIGN PATENT DOCUMENTS

| | | |
|---|---|---|
| EP | 0 312 675 A1 | 4/1989 |
| GB | 1272460 | 4/1972 |

* cited by examiner

*Primary Examiner*—Ramon O. Ramirez
*Assistant Examiner*—A. Joseph Wujciak

(57) ABSTRACT

A ground anchoring mechanism for attachment to an article, such as a beach umbrella, comprises an anchor post defining a lower pointed end and a horizontal step section extending sideways from the anchor post such that the anchor post may be translationally driven into the ground by using a person's foot onto the horizontal step section and driving the anchor post in the ground using the person's weight. The ground anchoring mechanism also includes at least one strap, and preferably a pair of such straps, which defines an opening for receiving an upper end of the anchor post and which comprises an elongated band, typically resilient, which is used to encircle the pole of the beach umbrella and secure the same to the anchor post. The strap also defines on an inner side thereof a concave recess which is adapted to receive part of the circumference of the umbrella's pole. Openings are defined in the elongated band such that the elongated band, once brought around the umbrella's pole, may be secured to a protrusion provided on an outside surface of the strap. The provision of an elastic elongated band and more than one openings therein allow for various diameters of poles to be accommodated within the strap.

20 Claims, 4 Drawing Sheets

GROUND ANCHORING MECHANISM

BACKGROUND OF THE INVENTION

1. Field of the Invention

The present invention relates to ground anchors and, more particularly, to a ground anchor for securing posts and associated equipment to the ground.

2. Description of the Prior Art

There is often a need for anchoring a post or the like to the ground. For instance, there are problems associated with inserting the bottom end of an umbrella post into the packed sand of a beach. Indeed, umbrellas have often tapered, although rounded, lower ends which are almost impossible to drive directly into the sand of a beach, that is without repeatedly moving the post sideways in a reciprocating manner while exerting downward pressure such as to gradually introduce the post in the ground. As a result, the opening in the sand does not hug the post which is therefore relatively loose even if sand is then manually packed therearound.

Various systems have been developed to assist in driving a support or post into the ground. For instance, U.S. Pat. No. 5,749,386 issued on May 12, 1998 to Samuel, Jr. discloses a golf umbrella and support which takes the form of a combination of a telescopically adjustable golf umbrella stand and a self-supporting golf umbrella adapted to be engageable into the ground by a spike extending from a lowermost portion thereof. A pivotable foot pedal extends substantially horizontally near the lower end of the lowermost portion apparently for driving the assembly into the ground. Furthermore, attachment straps having elastic insert portions and hook end loop fastening material (Velcro™) are provided on the umbrella handle mount of the umbrella stand to engage and encircle the umbrella handle positioned within.

European Patent Publication No. EP-0 312 675-A1 published on Apr. 26, 1989 in the name of Carbone discloses an umbrella having an auger-like lower post section which may be rotated with a removable tool mounted around the post and which may be rotated in a plane parallel to the ground such as to gradually introduce by rotation the umbrella into the ground.

British Patent Publication No. GB-1272460 published on Apr. 26, 1972 in the name of Asplin discloses a system similar to that of the aforementioned European Patent Publication and further discloses a second embodiment where a pair of triangular handles are integrally provided on the sides of the post for imparting rotation thereto such that the lower threaded end thereof gradually engages the ground.

U.S. Pat. No. 2,211,283 issued on Aug. 13, 1940 to Mercer, U.S. Pat. No. 4,832,304 issued on May 23, 1989 to Morgulis and U.S. Pat. No. 5,152,495 issued on Oct. 6, 1992 to Jacinto et al. all disclose umbrella anchoring mechanisms where the lower end of the umbrella post defines a screw-type thread and where a handle is provided at an intermediate portion of the post such that when it extends perpendicularly thereto it may be rotatably driven in a plane parallel to the ground such as to impart rotation to the post and gradually insert the same into the ground.

U.S. Pat. No. 5,156,369 issued on Oct. 20, 1992 to Tizzoni also discloses a ground anchoring arrangement for attachment, for example to the pull of a beach umbrella and consisting of a hollow cylindrical member having a rod rotatably supported therein. A spiral screw is attached to a lower end of the rod while the other end of the rod is attached to a handle rotator. Therefore, rotation of the handle rotator causes the rod and thus the spiral screw to rotate therewith such that the screw digs itself into the earth to firmly secure the hollow cylindrical member and the umbrella attached thereto to the ground.

SUMMARY OF THE INVENTION

It is therefore an aim of the present invention to provide a novel ground anchor for posts, such as for beach umbrellas.

It is also an aim of the present invention to provide an improved ground anchoring mechanism comprising a ground anchor post and at least one strap for securing the ground anchor post to an article, such as an umbrella.

Therefore, in accordance with the present invention, there is provided a ground engaging assembly for securing an article with respect to the ground, comprising a ground anchor and at least one strap, said anchor having an upper section, a lower section adapted to be driven into the ground, a side section extending such that when sufficient force is applied downwardly thereon said lower section of said anchor is driven at least partly into the ground, said strap being adapted to be brought around the article such as to secure the article to said ground anchor.

More specifically, said strap defines a vertical opening for receiving said upper section of said anchor and includes an elongated band adapted to extend around the article and to be attached to said strap in a securely closed loop. Typically, said elongated band is made of resilient material, and wherein said elongated band and an outer surface of said strap are provided with co-operating fastening means which, in a closed position thereof, retain said elongated band in said closed loop. Furthermore, said fastening means may comprise at least two holes defined in said elongated band and at least one protrusion on said outer surface capable of engaging either hole.

Also, an inner surface of said strap may define a recess for receiving part of a periphery of the article, wherein said recess is, for instance, concave.

Specifically, the vertical opening is oblong and is adapted to frictionally and tightly receive said upper section of said ground anchor. Said upper section can comprise a pair of parallel and vertical spaced sections adapted to slidably fit within said opening means. The side section can then be provided at a lower end of a first one of said vertical sections. More particularly, the anchor is of unitary construction, said vertical sections merging at upper ends thereof with an inverted U-shaped section, said first vertical section merging at a lower end thereof with said side section, a second one of said vertical sections extending downwardly to said lower section of said anchor and merging therewith, said side section including a horizontal portion extending outwardly from said lower end of said first vertical section and an angled portion extending downwardly and inwardly from an outer end of said horizontal portion and having a lower end thereof adjacent to said second vertical section which may, for instance, be welded to said second vertical section.

Also in accordance with the present invention, there is provided a strap for securing a first article to a second article, comprising an opening for securely receiving the first article, an elongated band adapted to extend around the second article and to be attached to said strap in a securely closed loop.

BRIEF DESCRIPTION OF THE DRAWINGS

Having thus generally described the nature of the invention, reference will now be made to the accompanying drawings, showing by way of illustration a preferred embodiment thereof, and in which.

DESCRIPTION OF THE PREFERRED EMBODIMENTS

In accordance with the present invention, there is proposed a ground anchoring mechanism M (see FIG. 4) comprised mainly of a ground anchor post and a pair of straps, wherein the straps generally secure the anchor post to another article, such as a pole P of an umbrella, e.g. a beach umbrella.

Figure 1:
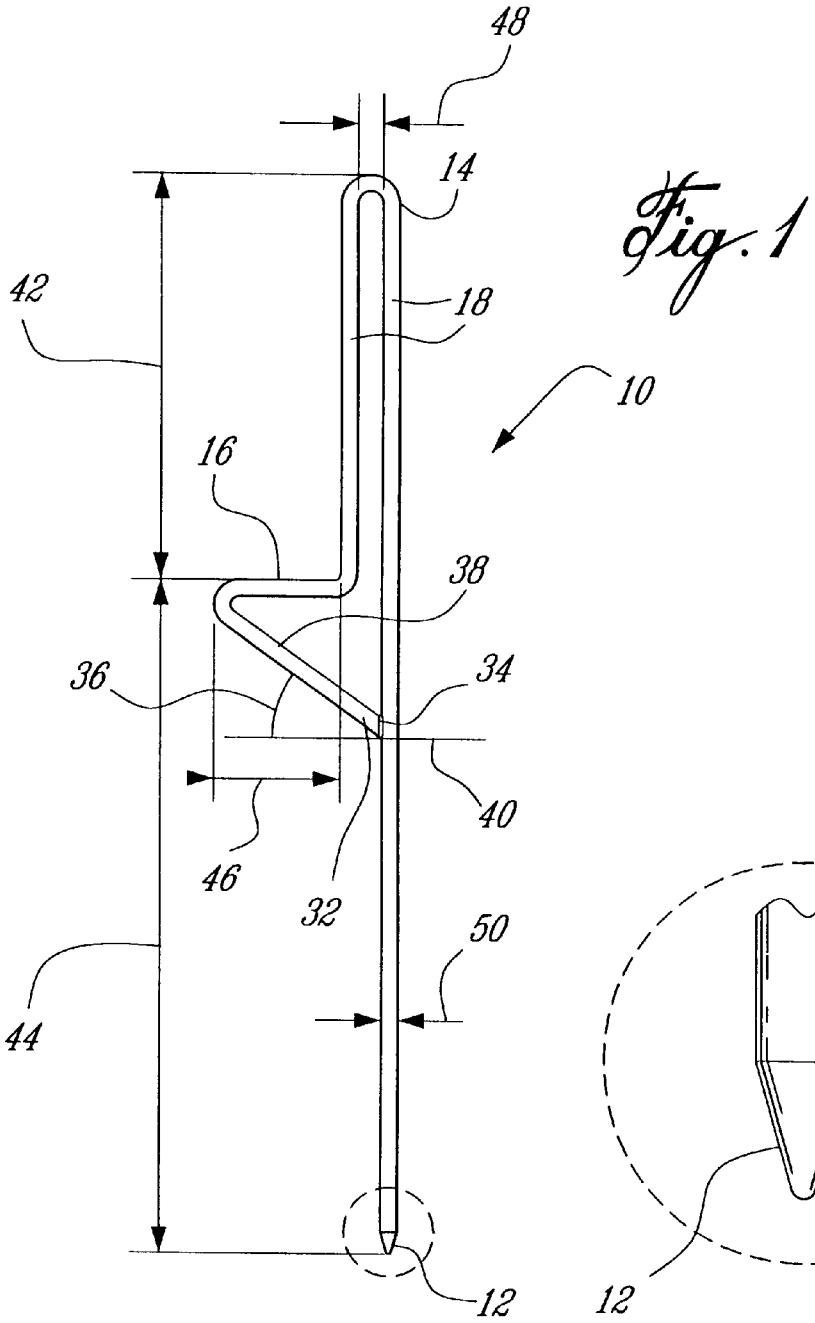
FIG. 1 is a side elevational view of the anchor post of a ground anchoring mechanism in accordance with the present invention.
Figure 1A:
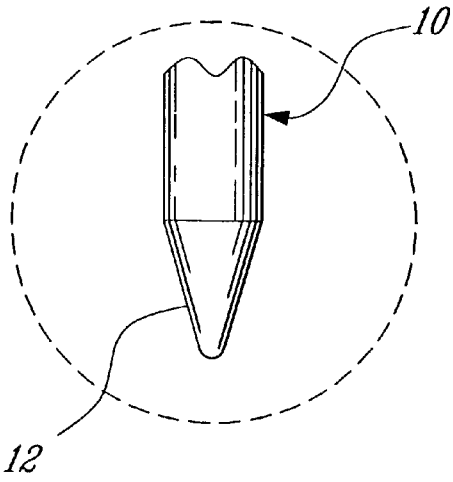
FIG. 1A is an enlarged schematic view of a lower tapered end of the anchor post of FIG. 1.
Figure 4:
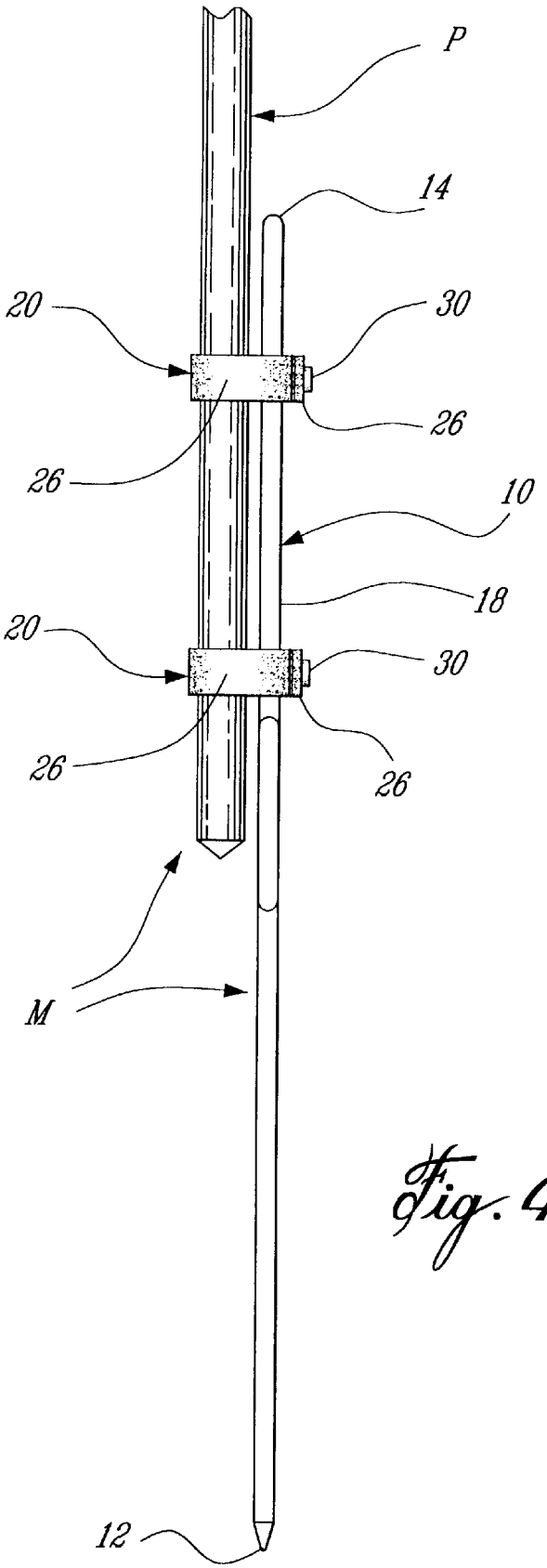
FIG. 4 is a schematic partial side elevational view of the ground anchoring mechanism of the present invention, including its anchor post and two straps, connected to the pole of an umbrella.

More particularly, the ground anchoring mechanism M includes an anchor post 10, as illustrated in FIG. 1 and shown sideways in FIG. 4. The anchor post 10 has a lower pointed end 12 and is inturned at its upper end 14. At the bottom of the inturned upper end 14, there is defined a horizontal step section 16. The inturned upper end 14 includes a pair of space apart and parallel rod sections 18 which merge together in a U-shaped pattern at an upper end thereof and with the horizontal step section 16 depending from a lower end of one of the rod sections 18. The anchor post 10 is of unitary construction. The horizontal step section 16 allows for the anchor post 10 to be translationally driven into the ground using a person's foot and weight.

Figure 2:
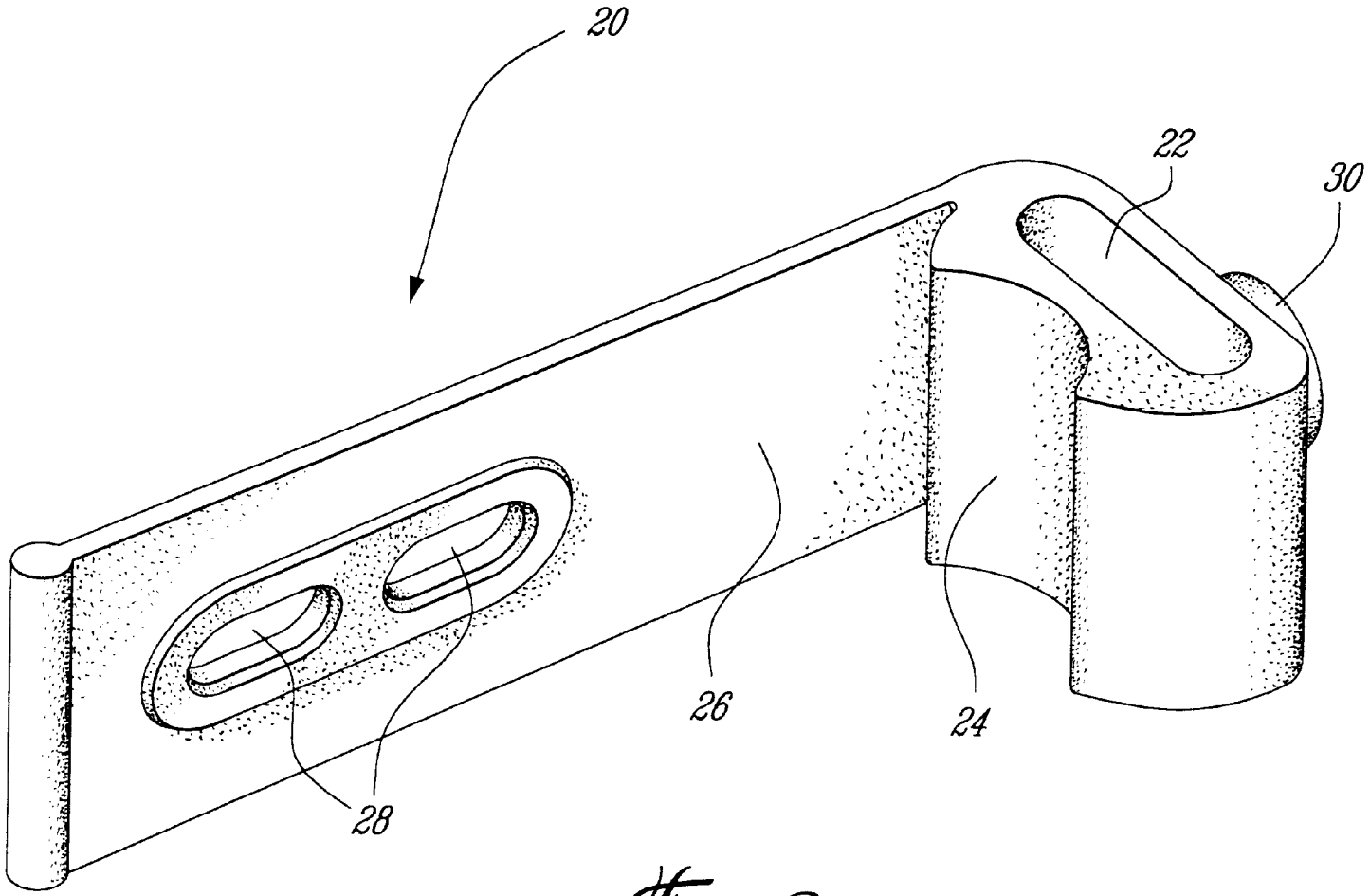
FIG. 2 is a perspective view of a strap also in accordance with the present invention and used for connecting the anchor post to another article, such as an umbrella's pole.
Figure 3:
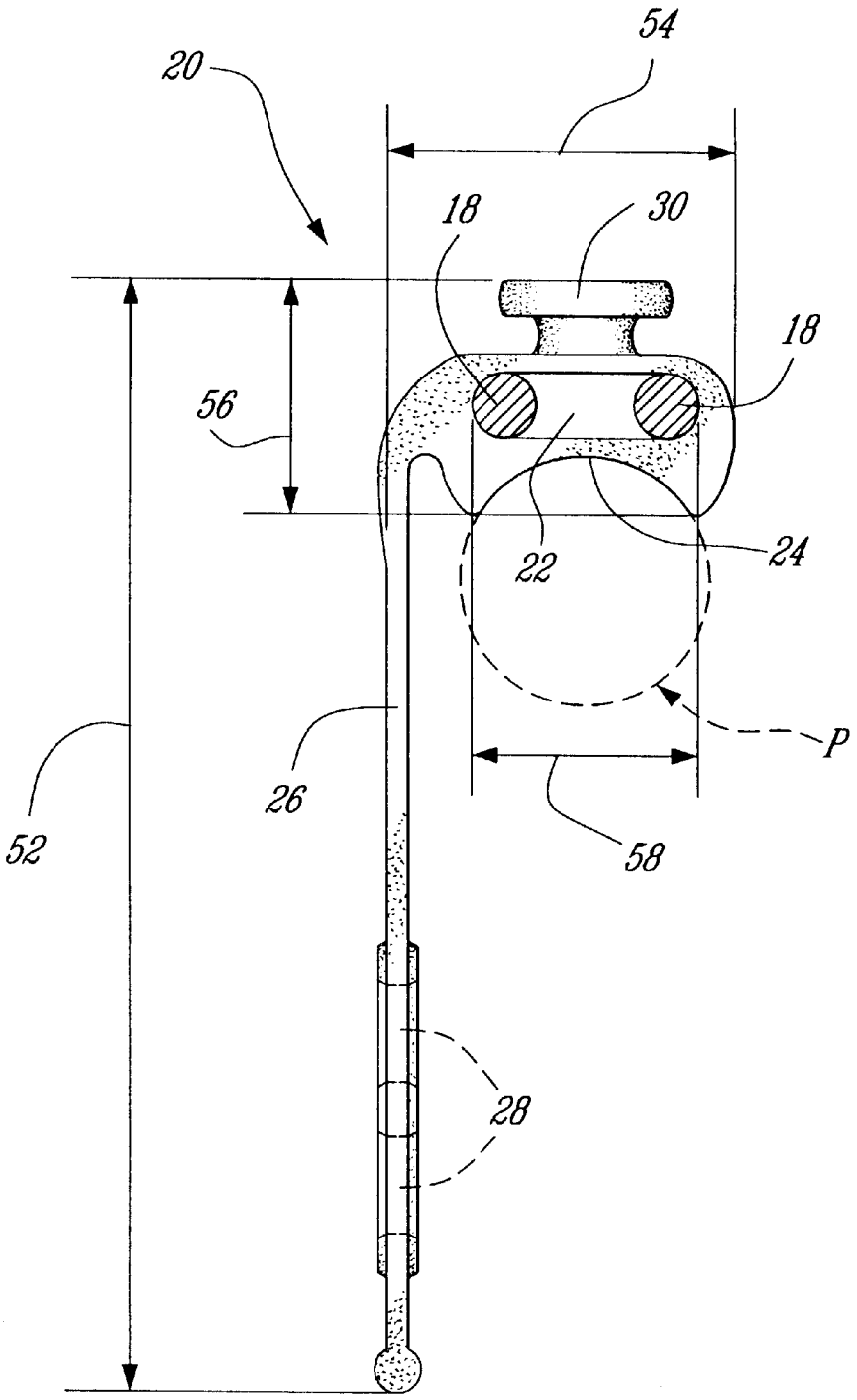
FIG. 3 is a top plan view of the strap of FIG. 2 and schematically showing therein a pair of rod sections of the anchor post of FIG. 1.

The ground anchoring mechanism M also includes a pair of resilient straps which are illustrated in FIGS. 2 and 3. Each resilient strap 20 defines an oblong opening 22 for sliding the strap 20 along the rod sections 18 of the anchor and reference is made to the position of the rod sections 18 within the oblong opening 22 in FIG. 3 and to the relative positions of the two resilient straps 20 onto the inturned upper end 14 of the anchor post 10 in FIG. 4.

Furthermore, each strap 20 defines on an inner side thereof a concave recess 24 adapted to receive therein part of the circumference of the circular pole P of the umbrella. The strap 20 also includes an elongated band 26 which defines a pair of oblong openings 28 adapted to be selectively engaged in an horizontally elongated protrusion 30 defined in a side of the oblong opening which is opposite the side defining the concave recess 24. Therefore, the elongated band 26 can be brought around the pole P and outwardly of the oblong opening 22 such as to engage the protrusion 30 in a selected one of the oblong openings 28.

Therefore, the straps are first engaged along the rod sections 18 of the anchor post 10, in a vertically space apart relationship. The pole P is then positioned such as to nest in the recesses 24 of the resilient straps 20, and the bands 26 of the straps 20 can then be brought around the pole P and engaged at their appropriate openings 28 into the protrusions 30 of both resilient straps 20 thereby maintaining the pole P securely attached to the anchor post 10, as seen in FIG. 4. The resiliency of the elongated bands 26 of the straps 20 allow for various diameters of poles to be accommodated with a same system. Moreover, the provision of more than one opening 28 in the elongated band 26 further allows the straps 20 to receive posts of various transversal dimensions.

The pole P can be attached to the anchor post 10 with the straps 20 before or after the anchor post 10 is driven with one's foot into the ground. Indeed, the anchor post 10 alone can be driven into the ground and then the pole P may be attached thereto using the straps 20; alternatively, the pole P may be secured to the anchor post 10 with the straps 20 before the anchor post 10 is driven into the ground.

As seen in FIG. 1, the unitary anchor post 10 may be made by bending a single steel rod and a free end 32 of the anchor post 10, opposite the lower pointed end 12 thereof, may be welded at 34 (or otherwise secured) to the main rod section 18, that is the one that extends to the lower pointed end 12 such that the parallel rod sections 18 and the horizontal step section 16 form a closed loop thereby increasing the overall rigidity.

In the illustrated embodiment, although other configurations may be obviously contemplated, an angle 36 between an angled section 38 of the shortest rod section 18 and a horizontal plane 40 is of about 30°. Dimensions 42, 44, 46 and 48 may be respectively of approximately 9", 14¼", 3" and 0.5". The diameter 50 of the rod sections 18, the upper end 14 and the step section 16 of the anchor post 10 is, for instance, of ⅜ inch.

As to the straps 20, dimensions 52, 54, 56 and 58 may be of approximately 7⅜", 1½", 1¼" and 1¼", respectively. The width of the straps 20 can, for instance, be of about 1". The steel rod sections 18 are held vice-like inside the strap opening 22.

The present ground anchoring mechanism M can, for instance, accommodate substantially cylindrical members, such as the pole P, having diameters within a range, such as between ¾" and 1½", which depends on various factors, such as gap 48, the curvature and configuration of the concave recess 24, rod diameter 50, the number, size and disposition of openings 28, etc.

The ground anchoring mechanism M can be driven in sand, soil, etc., and through grass into the ground for holding a multitude of objects, e.g. beach umbrellas, ground umbrellas (extending, for instance, through an outdoors table and into the grass), badminton or volleyball net support poles, lighting fixtures or torches, etc.

I claim:

1. A ground engaging assembly for securing an elongated article with respect to the ground, comprising a ground anchor and at least one strap, said anchor having an upper section, a lower section adapted to be driven into the ground, a side section extending transversally outwardly such that when sufficient force is applied downwardly thereon said lower section of said anchor is driven at least partly into the ground, said strap being adapted to be brought around the article such as to secure the article at least along said upper section with said side section extending sufficiently outwardly of both said upper section and the article such as to be engagable by a foot of the user.

2. A ground engaging assembly as defined in claim 1, wherein an inner surface of said strap defines a recess for receiving part of a periphery of the article, said recess being concave.

3. A ground engaging assembly for securing an elongated article with respect to the ground, comprising a ground anchor and at least one strap, said anchor having an upper section, a lower section adapted to be driven into the ground, a side section extending transversally outwardly such that when sufficient force is applied downwardly thereon said lower section of said anchor is driven at least partly into the ground, said strap being adapted to be brought around the article such as to secure the article at least along said upper section with said side section extending sufficiently outwardly of both said upper section and the article such as to be engagable by a foot of the user, wherein said strap defines a vertical opening for receiving said upper section of said anchor and includes an elongated band adapted to extend around the article and to be attached to said strap in a securely closed loop said upper section of said anchor extending completely through said vertical opening such that said strap is located intermediate opposed longitudinal ends of said upper section.

4. A ground engaging assembly as defined in claim 3, wherein said elongated band is made of resilient material, and wherein said elongated band and an outer surface of said strap are provided with co-operating fastening means which, in a closed position thereof, retain said elongated band in said closed loop.

5. A ground engaging assembly as defined in claim 4, wherein said fastening means comprise at least one protrusion extending transversally of said strap and at least one hole adapted to releasably receive said protrusion.

6. A ground engaging assembly as defined in claim 5, wherein said fastening means comprise at least two holes defined in said elongated band and at least one protrusion on said outer surface capable of engaging either one of the two holes.

7. A ground engaging assembly as defined in claim 6, wherein said holes of said elongated band and said protrusion are oblong-shaped.

8. A ground engaging assembly as defined in claim 3, wherein said vertical opening is of substantially oblong cross-section and is adapted to frictionally and tightly receive said upper section of said ground anchor.

9. A ground engaging assembly as defined in claim 8, wherein said upper section comprises a pair of parallel and vertical spaced sections adapted to slidably fit within said vertical opening.

10. A ground engaging assembly as defined in claim 9, wherein said side section is provided at a lower end of a first one of said vertical sections.

11. A ground engaging assembly as defined in claim 10, wherein said anchor is an unitary construction, said vertical sections merging at upper ends thereof with an inverted U-shaped section, said first vertical section merging at a lower end thereof with said side section, a second one of said vertical sections extending downwardly to said lower section of said anchor and merging therewith.

12. A ground engaging assembly as defined in claim 11, wherein said side section includes a horizontal portion extending outwardly from said lower end of said first vertical section and an angled portion extending downwardly and inwardly from an outer end of said horizontal portion and having a lower end thereof adjacent to said second vertical section.

13. A ground engaging assembly as defined in claim 12, wherein said lower end of said angled portion is welded to said second vertical section.

14. A strap for securing a first article to a second article, comprising a first end defining an opening for securely receiving the first article such that the first article extends therein along an axis of said opening, an elongated band extending from said first end and substantially at right angles to said axis of said opening, said band having a free end and being adapted to extend around the second article and to be attached at said free end to a location of said first end in a securely closed loop, wherein said opening extends between said location and said closed loop.

15. A strap as defined in claim 14, wherein said elongated band is made of resilient material, and wherein said elongated band and an outer surface of said first end are provided with co-operating fastening means which, in a closed position thereof, retain said elongated band in said closed loop.

16. A strap as defined in claim 15, wherein said fastening means comprise at least one protrusion extending transversally of said first end and at least one hole in said band adapted to releasably receive said protrusion.

17. A strap as defined in claim 16, wherein said fastening means comprise at least two holes defined in said elongated band and at least one protrusion on said outer surface.

18. A strap as defined in claim 14, wherein an inner surface of said first end defines a recess for receiving part of a periphery of the second article, and oriented such that when the first and second articles are attached to said strap, the first and second articles extend substantially parallel.

19. A strap as defined in claim 18, wherein said recess is concave.

20. A strap as defined in claim 14, wherein said opening is of oblong cross-section and is adapted to frictionally receive the first article.

* * * * *

UNITED STATES PATENT AND TRADEMARK OFFICE

CERTIFICATE OF CORRECTION

PATENT NO. : 6,412,748 B1
DATED : July 2, 2002
INVENTOR(S) : Martin Girard

It is certified that error appears in the above-identified patent and that said Letters Patent is hereby corrected as shown below:

Title page,
Insert:
-- [30] Foreign Application Priority
August 24, 1998 [CA] 2,245,596 --

Signed and Sealed this

Twentieth Day of May, 2003

JAMES E. ROGAN
*Director of the United States Patent and Trademark Office*